US005900078A

United States Patent [19]

Yakuwa et al.

[11] Patent Number: 5,900,078

[45] Date of Patent: May 4, 1999

[54] HIGH-TEMPERATURE SULFIDATION-CORROSION RESISTANT NICKEL-BASE ALLOY

[75] Inventors: Hiroshi Yakuwa; Matsuho Miyasaka, both of Fujisawa; Toshio Narita, Sapporo; Shuhei Nakahama; Masamichi Kawasaki, both of Tokyo, all of Japan

[73] Assignee: Ebara Corporation, Tokyo, Japan

[21] Appl. No.: 08/801,192

[22] Filed: Feb. 14, 1997

[30] Foreign Application Priority Data

Feb. 16, 1996 [JP] Japan ..... 8-054054

[51] Int. Cl.[6] ..... C22C 19/05

[52] U.S. Cl. ..... 148/410; 148/428; 420/446; 420/448; 420/449

[58] Field of Search ..... 148/410, 428; 420/446, 449, 448

[56] References Cited

U.S. PATENT DOCUMENTS

| | | | |
|---|---|---|---|
| 3,046,108 | 7/1962 | Eiselstein | 148/675 |
| 3,207,599 | 9/1965 | Franklin | 148/675 |
| 3,898,109 | 8/1975 | Shaw | 148/675 |
| 4,121,950 | 10/1978 | Guimier et al. . | |
| 4,608,094 | 8/1986 | Miller et al. . | |

FOREIGN PATENT DOCUMENTS

| | | |
|---|---|---|
| 0 142 668 A1 | 5/1985 | European Pat. Off. . |
| 0 338 574 A1 | 10/1989 | European Pat. Off. . |
| 0 361 524 A1 | 4/1990 | European Pat. Off. . |

OTHER PUBLICATIONS

Chester T. Sims et al., "Superalloys II", John Wiley & Sons, Inc., 1987, pp. 353–356.

George Y. Lai, "High–Temperature Corrosion of Engineering Alloys", ASM International, 1990, pp. 128–138.

Microstructure; 1988; ASM International, Metals Park, Ohio, USA; pp. 33–35; XP002030728; E. F. Bradley: "Superalloys—A Technical Guide".

Metallurgical Transactions B; Process Metallurgy, vol. 11B, Mar. 1980, New York, USA; pp. 147–158; XP002030726; R. H. Kane: Hot Workability of Nickel–Containing Alloys After Reheating Using Sulfur–Containing Fuel.

Metallurgical Transactions A Physical Metallurgy and Materials Science, vol. 15A, Jan. 1984, New York, USA; pp. 23–28; XP002030727; G. A. Whitlow et al.: "The Effects of a Liquid Sulfate/Chloride environment on Superalloy Stress Rupture Properties at 1300° F. (704° C.)".

*Primary Examiner*—Margery Phipps

*Attorney, Agent, or Firm*—Armstrong, Westerman, Hattori, McLeland & Naughton

[57] ABSTRACT

A high-temperature sulfidation-corrosion resistant nickel-base alloy includes 12~15 weight % of cobalt, 18~21 weight % of chromium, 3.5~5 weight % of molybdenum, 0.02~0.1 weight % of carbon, at most 2.75 weight % of titanium, and at least 1.6 weight % of aluminum. The remainder is essentially of nickel except for impurities. The high-temperature sulfidation-corrosion resistant nickel-base alloy has sufficient high-temperature strength and is highly resistant to a high-temperature sulfidation corrosion.

14 Claims, 12 Drawing Sheets

| Mark | Test No. |
|---|---|
| --●-- | Co. Ex. (Waspaloy) |
| —○— | In. Ex. 1 (3.0Al/2.0Ti) |
| —●— | In. Ex. 2 (2.5Al/2.0Ti) |
| —△— | In. Ex. 3 (2.0Al/2.0Ti) |

| Mark | Test No. |
|---|---|
| - - -●- - - | Co. Ex. (Waspaloy) |
| —○— | In. Ex. 4 (3.5Al/1.5Ti) |
| —●— | In. Ex. 5 (3.0Al/1.5Ti) |
| —△— | In. Ex. 6 (2.5Al/1.5Ti) |

HIGH-TEMPERATURE SULFIDATION-CORROSION RESISTANT NICKEL-BASE ALLOY

BACKGROUND OF THE INVENTION

1. Field of the Invention

The present invention relates to a high-temperature sulfidation-corrosion resistant nickel-base alloy for use as, for example, a material for a gas expander turbine which facilitates utilization of recovered energy from exhaust gas discharged from a fluidized-bed catalytic cracking apparatus of a petroleum refining plant.

2. Description of the Prior Art

Heat-resistant nickel-base alloys which have been used as a material for a turbine rotor which is exposed to high temperatures have a high resistance against oxidation and creep as well as a high temperature strength.

Many heat-resistant nickel-base alloys contain small amounts of titanium (Ti) and aluminum (Al) to precipitate a gamma prime (γ') phase of $Ni_3(Ti,Al)$ for achieving good high-temperature strengths. Usually, those heat-resistant nickel-base alloys contain less than 1.6 weight % of aluminum and more than 2.5 weight % of titanium. As the total amount of added titanium and aluminum in a heat-resistant nickel-base alloy increases, the forgeability of the alloy decreases. If it is necessary that the total amount of titanium and aluminum exceeds 6 weight %, then the alloy will more often be formed as castings than forgings.

High-temperature mechanical devices such as turbines, boilers, etc. that find use in combustion gas atmospheres are known to be subject to a process of "hot corrosion" in which a molten salt containing sodium (Na), sulfate ($SO_4$), vanadium (V), and/or chlorine (Cl) play a certain role. It has also been reported that nickel-base alloys suffer a catastrophic sulfidation corrosion at a temperature of or higher than 700° C. due to a direct reaction between gases and metals without mediation of a molten salt. The catastrophic sulfidation corrosion is believed to occur to nickel-base alloys due to, among other causes, the formation of a eutectic of Ni—$Ni_3S_2$ which has a low melting point of 645° C.

There have recently been developed energy recovery systems for recovering the energy of exhaust gases which are discharged from fluidized-bed catalytic cracking apparatus in order to save energy in petroleum refining plants. As a material for manufacturing turbine blades of the gas expander for use in such an energy recovery system, "Waspaloy (trade name)" was experimentally employed which is a typical heat-resistant nickel-base alloy. However, a sulfidation corrosion has been found at proximal ends of the turbine blades which were used in a temperature range lower than usual temperatures for causing a sulfidation corrosion resulting in an undue reduction in the service life of the turbine blades. An inspection of a cross section of the corroded region has indicated that, as shown in FIG. 1 of the accompanying drawings, the corroded region has developed an upper layer including nickel sulfide and a lower layer including chromium sulfide, and the sulfidation has been in progress deeply along alloy grain boundaries. However, the inspection of the corroded region has not revealed any products including Na, Cl, $SO_4$, and/or V which would otherwise give a sign of the formation of a molten salt.

FIG. 2 of the accompanying drawings is a microscopic structural representation showing, in cross section, results of a high-temperature sulfidation-corrosion test conducted on a conventional nickel-base alloy in a sulfidizing gas atmosphere for the purpose of finding causes of the sulfidation corrosion. The high-temperature sulfidation-corrosion test was carried out under a sulfur partial pressure ($PS_2$) of $10^{-8.6}$ atm. at a temperature of 600° C. for 96 hours. In the high-temperature sulfidation-corrosion test, the nickel-base alloy suffered a sulfidation corrosion as shown in FIG. 2, which was a reproduction of the corroded region shown in FIG. 1. It was confirmed as a result of the high-temperature sulfidation-corrosion test that a grain boundary sulfidation corrosion is caused by a direct reaction between the metals and the gases without the formation of a molten salt containing Na, Cl, $SO_4$, and/or V. There have been almost no reports on the occurrence of a grain boundary sulfidation corrosion on nickel-base alloys in a sulfidizing gas atmosphere at a temperature of or lower than 645° C. Consequently, any behaviors and mechanisms of such a grain boundary sulfidation corrosion have not been clarified in the art so far.

SUMMARY OF THE INVENTION

It is therefore an object of the present invention to provide a nickel-base alloy which has sufficient high-temperature strength and is highly resistant to a high-temperature sulfidation corrosion.

According to the present invention, there is provided a high-temperature sulfidation-corrosion resistant nickel-base alloy comprising 12~15 weight % of cobalt, 18~21 weight % of chromium, 3.5~5 weight % of molybdenum, 0.02~0.1 weight % of carbon, at most 2.75 weight % of titanium, at least 1.6 weight % of aluminum, and a remainder essentially of nickel except for impurities.

Preferably, the amount of titanium is at most 2 weight % for improving sulfidation corrosion resistance. More preferably, the amount of titanium is in the range of from 1.0 to 2.0 weight %.

Preferably, the amount of aluminum is in the range of from 1.6 to 4.0 weight %. With the amount of aluminum being in the range of from 1.6 to 4.0 weight %, the amount of titanium is preferably at most 2 weight %, and more preferably at least 1 weight %.

Preferably, the total amount of titanium and aluminum is at least 4.0 weight %, and more preferably in the range of from 4.0 to 5.0 weight %. With the total amount of titanium and aluminum being in the range of from 4.0 to 5.0 weight %, the amount of titanium is preferably at most 2 weight %.

According to the present invention, there is also provided a high-temperature sulfidation-corrosion resistant precipitation-hardened nickel-base alloy comprises at most 2.0 weight % of titanium, at least 2.0 weight % of aluminum, and a remainder essentially of nickel except for impurities.

The high-temperature sulfidation-corrosion resistant nickel-base alloy or the high-temperature sulfidation-corrosion resistant precipitation-hardened nickel-base alloy further includes 0.003~0.01 weight % of boron and 0.02~0.08 weight % of zirconium.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
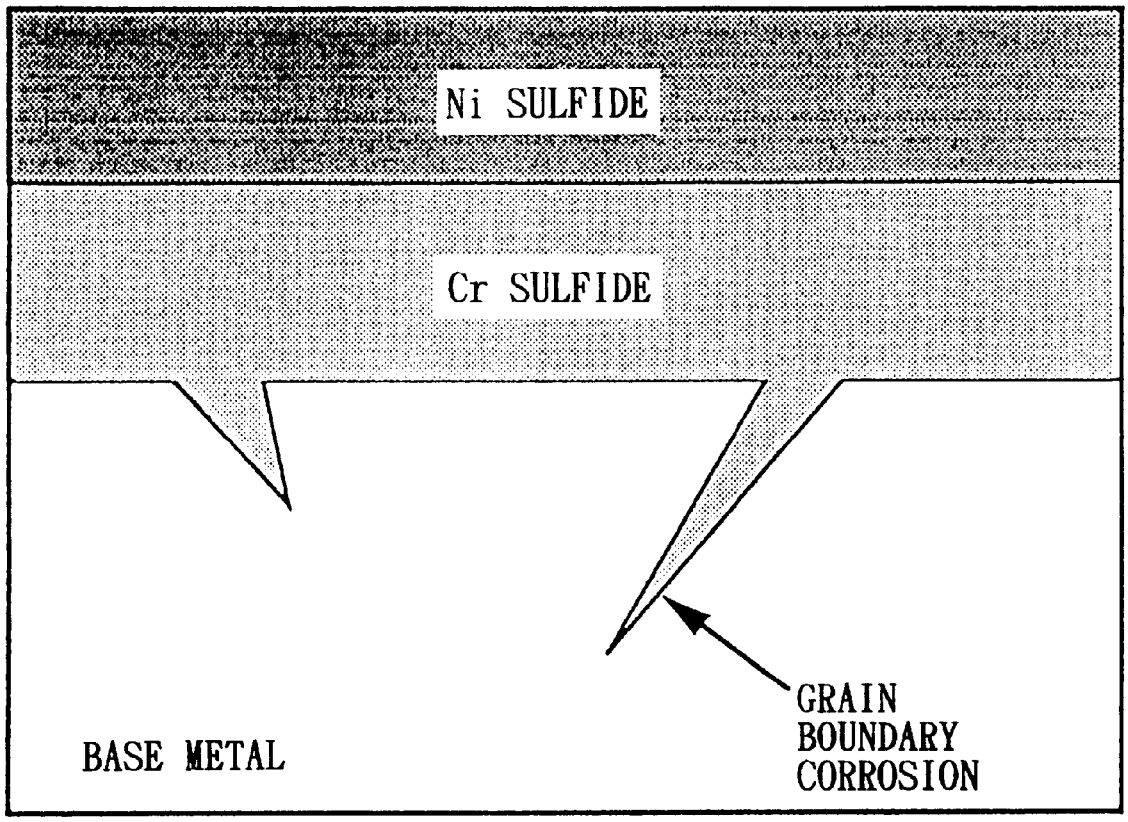
FIG. 1 is a schematic cross-sectional view of a nickel-base alloy which suffers a sulfidation corrosion.
Figure 2:
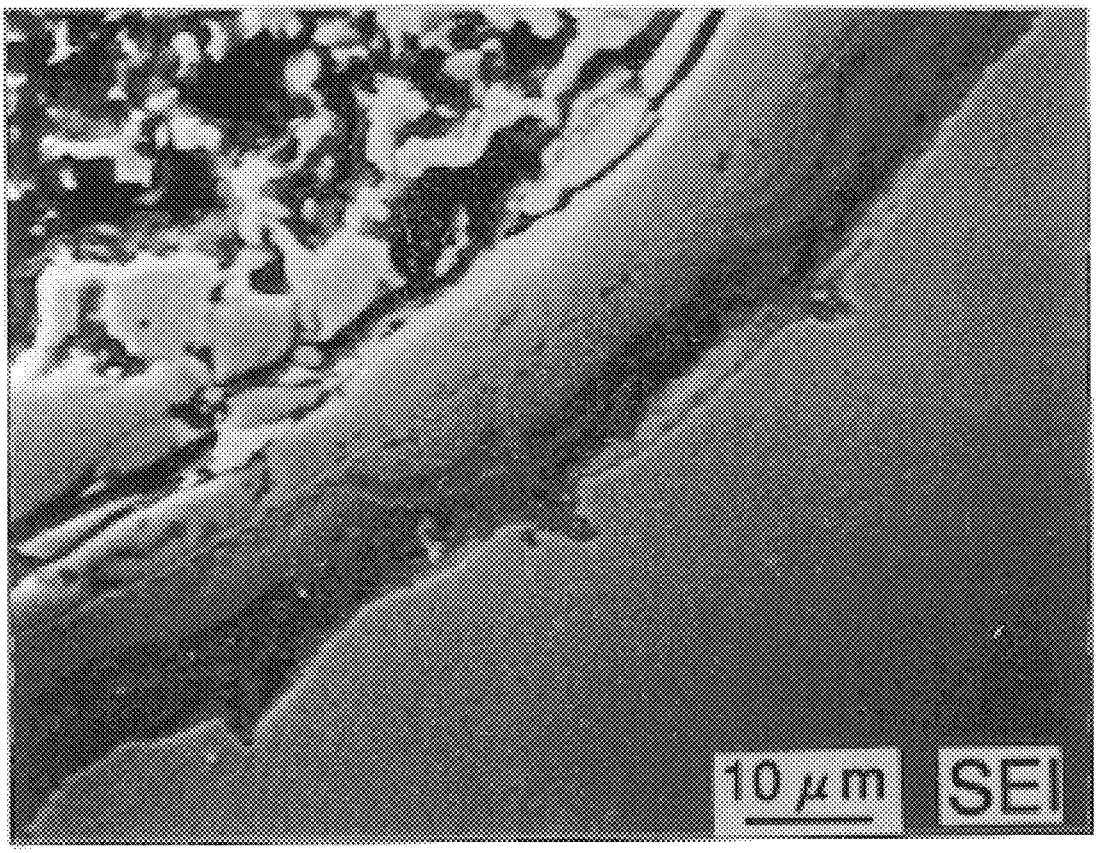
FIG. 2 is a microscopic structural representation of a cross section of a conventional nickel-base alloy, showing results of a high-temperature sulfidation-corrosion test conducted on the nickel-base alloy.
Figure 3A:
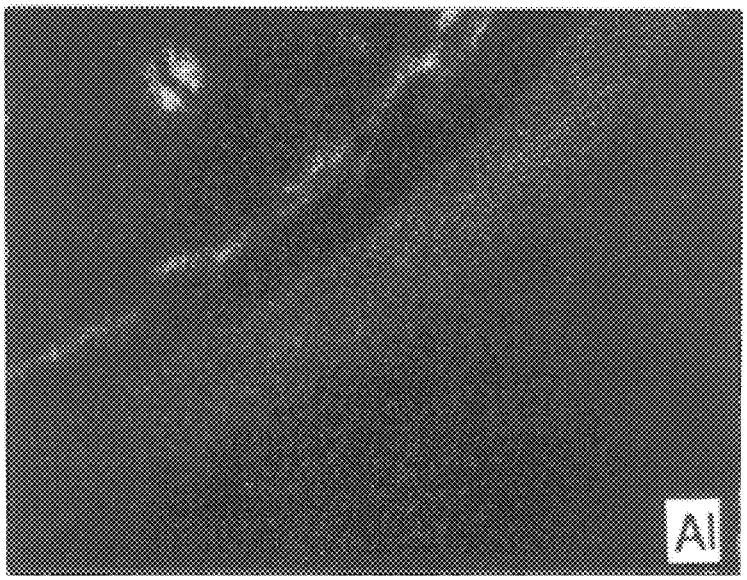
FIGS. 3(A) and 3(B) are views showing results of an electron probe microanalysis of the cross section, shown in FIG. 2, of the conventional nickel-base alloy after the high-temperature sulfidation-corrosion test conducted thereon.
Figure 3B:
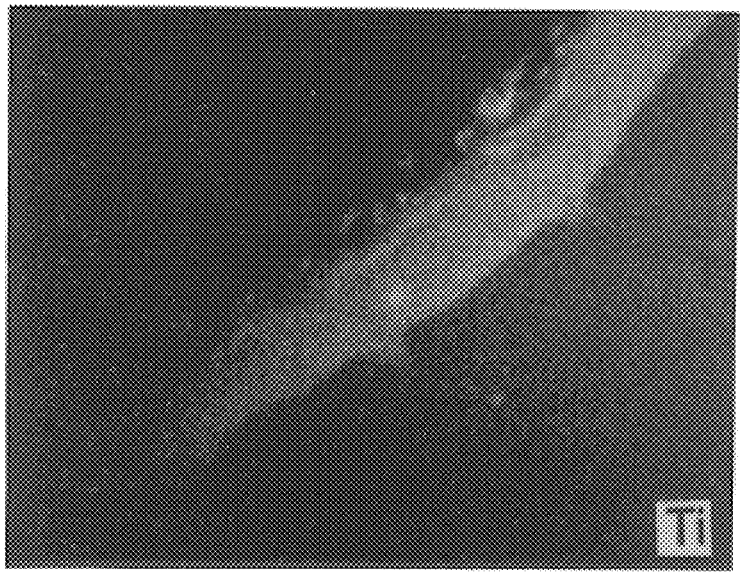
Figure 4A:
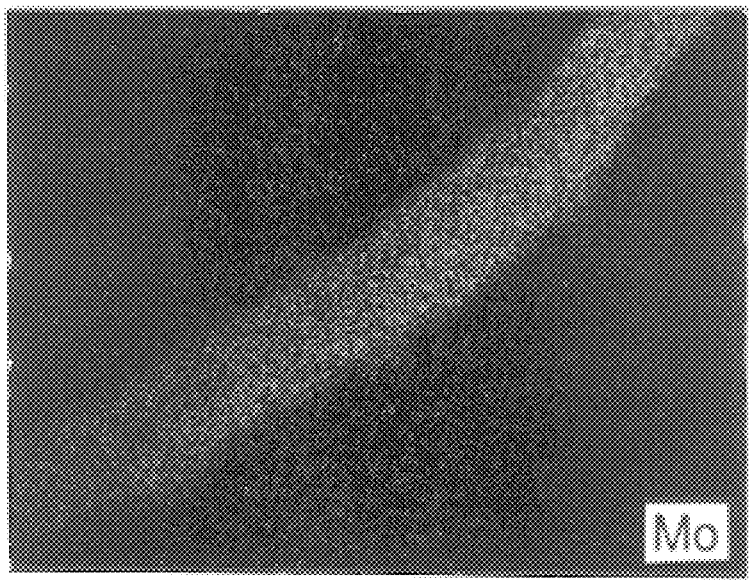
FIGS. 4(A) and 4(B) are views showing results of an electron probe microanalysis of the cross section, shown in FIG. 2, of the conventional nickel-base alloy after the high-temperature sulfidation-corrosion test conducted thereon.
Figure 4B:
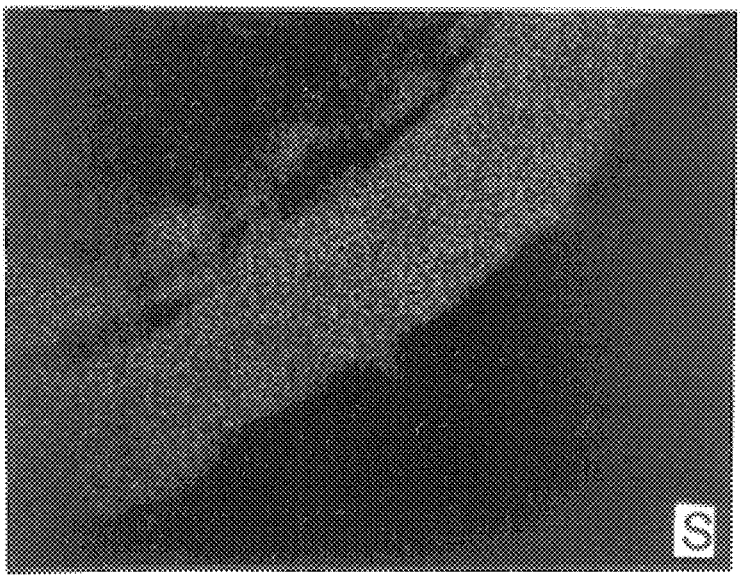

In order to determine conditions in which a sulfidation corrosion occurs, the cross section shown in FIG. 2 of the conventional nickel-base alloy was inspected for a distribution of chemical elements contained therein. As a result of the inspection, it was found that titanium (Ti), aluminum (Al), and molybdenum (Mo) contained in the nickel-base alloy were concentrated in the innermost sulfide layers including grain boundaries in the nickel-base alloy, as shown in FIGS. 3(A), 3(B) and 4(A), 4(B). A detailed examination of the cross section shown in FIG. 2 indicated that molybdenum had no significant effect on the sulfidation in the nickel-base alloy, whereas the concentrations of titanium and aluminum greatly affected the sulfidizing process.

Figure 5:
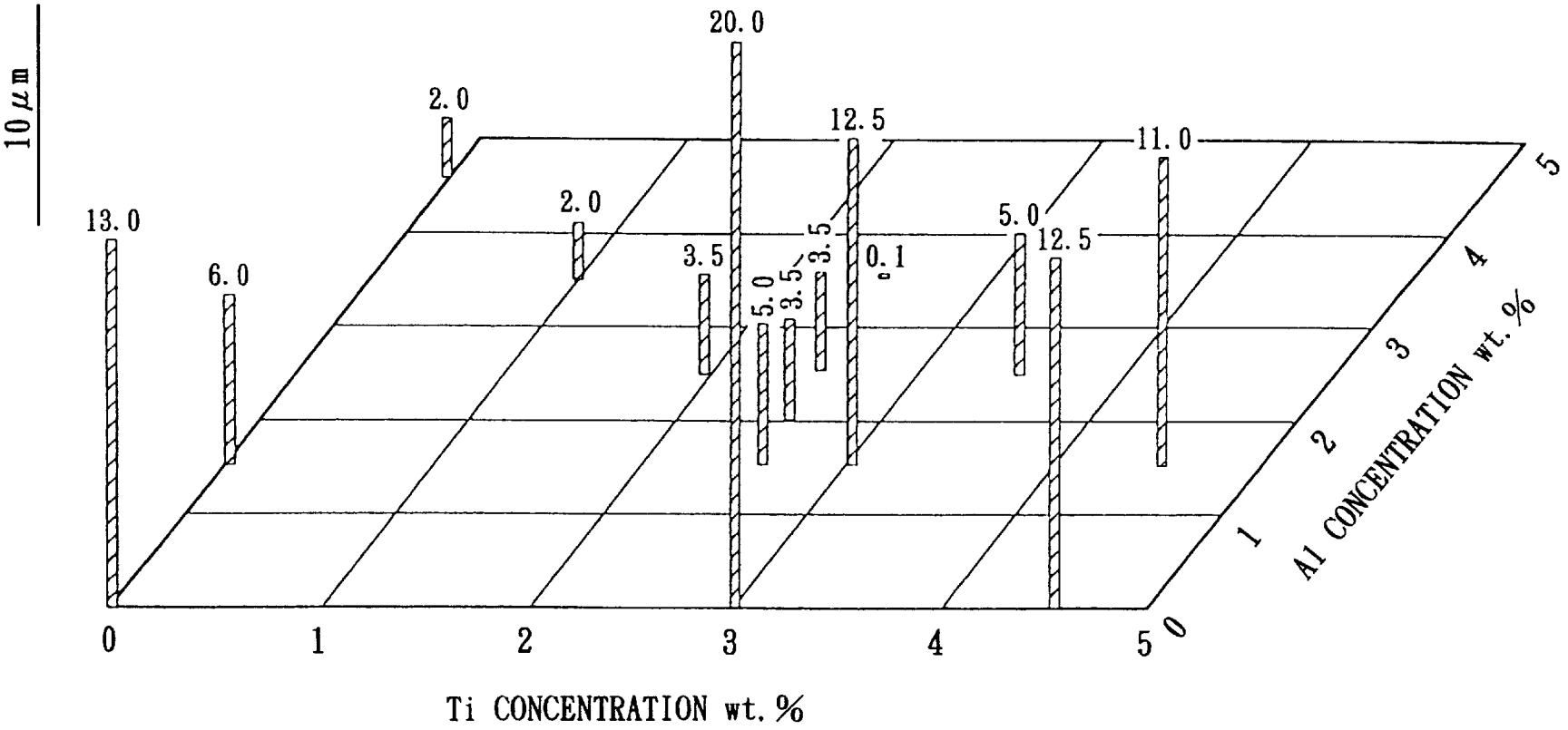
FIG. 5 is a graph showing how the concentrations of titanium and aluminum affect internal sulfidation depths in nickel-base alloys.

In another experimental process, nickel-base alloy samples having common concentrations of cobalt (Co), chromium (Cr), and molybdenum, i.e., 13 weight % of cobalt, 20 weight % of chromium, and 4 weight % of molybdenum, and different concentrations of titanium and aluminum, were prepared and then checked for sulfidation behavior thereof. FIG. 5 shows the relationship between the concentrations of titanium and aluminum and the thicknesses of internal sulfidation layers or the lengths of sulfidized grain boundaries in the nickel-base alloys. It can be understood from FIG. 5 that the thickness of an internal sulfidation layer is smaller as the concentration of titanium is smaller and the concentration of aluminum is greater. Stated otherwise, the sulfidation in a nickel-base alloy can be reduced when titanium is added in a smaller concentration and aluminum is added in a greater concentration.

According to the present invention, a high-temperature sulfidation-corrosion resistant nickel-base alloy comprises 12~15 weight % of cobalt, 18~21 weight % of chromium, 3.5~5 weight % of molybdenum, 0.02~0.1 weight % of carbon (C), at most 2.75 weight % of titanium, at least 1.6 weight % of aluminum, and a remainder essentially of nickel except for impurities.

In the high-temperature sulfidation-corrosion resistant nickel-base alloy, the cobalt itself serves as a solid solution to strengthen the matrix of the nickel-base alloy, and also reduces the amount of a gamma prime (γ') phase contained as a solid solution in the nickel-base alloy and increases the precipitated amount of the γ' phase for thereby strengthening the matrix of the nickel-base alloy. If the amount of cobalt were smaller than 12 weight %, then the strengthening effect thereof would be insufficient. If the amount of cobalt were greater than 15 weight %, then it would generate harmful intermetallic compounds such as a sigma (σ) phase, resulting in a reduction in the creep strength. For the above reasons, the amount of cobalt is limited to the range of 12~15 weight %.

The chromium forms a stable and dense oxide film on the nickel-base alloy to increase its resistance to oxidation in corrosive environments, e.g. oxidizing acids and high-temperature oxidizing atmospheres. The chromium is also inclined to couple with the carbon so as to precipitate carbides including $Cr_7C_3$, $Cr_{23}C_6$, etc. for increased high-temperature strength. If the amount of chromium were less than 18 weight %, the above effects, particularly, the oxidation resistance, would be insufficient. If the amount of chromium exceeds 21 weight %, then it would accelerate the generation of harmful intermetallic compounds such as a σ phase. For the above reasons, the amount of chromium is limited to the range of 18~21 weight %.

The molybdenum forms a solid solution mainly with a γ phase and a γ' phase for thereby increasing the high-temperature strength of the nickel-base alloy, and also improves corrosion resistance of the nickel-base alloy against hydrochloric acid or the like. If the amount of molybdenum were smaller than 3.5 weight %, then its capabilities described above would be not enough. If the amount of molybdenum were in excess of 5 weight %, then it would make unstable structure of the nickel-base matrix. For these reasons, the amount of molybdenum is limited to the range of 3.5~5 weight %.

The carbon is combined with the titanium, forming titanium carbide (TiC). The carbon is also combined with the chromium and the molybdenum, forming carbides including $M_6C$, $M_7C_3$, and $M_{23}C_6$. These carbides are effective in suppressing an increase of the grain size. The compounds $M_6C$ and $M_{23}C_6$ are precipitated in adequate quantities into grain boundaries, thereby strengthening the grain boundaries. If the amount of carbon were smaller than 0.02 weight %, then the above effects would not be developed. If amount of carbon were greater than 0.1 weight %, the amount of titanium required for precipitation strengthening of the nickel-base alloy would be short. For these reasons, the amount of carbon is limited to the range of 0.02~0.1 weight %.

The titanium and the aluminum are mainly transformed into $Ni_3(Ti,Al)$, precipitating a γ phase thereof which develops precipitation strengthening of the nickel-base alloy. As the amount of titanium increases, it promotes a sulfidation corrosion in the nickel-base alloy. Therefore, the amount of titanium is reduced to at most 2.75 weight %. The reduction in the amount of titanium is made up for by the amount of aluminum which is at least 1.6 weight %, thereby keeping the nickel-base alloy at a sufficient level of high-temperature strength and increasing the ability of the nickel-base alloy to resist sulfidation, particularly internal sulfidation including grain boundary corrosion.

Preferably, the amount of titanium is at most 2 weight % for improving sulfidation corrosion resistance.

More preferably, the amount of titanium is in the range of from 1.0 to 2.0 weight % for achieving both sulfidation corrosion resistance and creep strength required for the nickel-base alloy to be used as a material of rotor blades for gas expander turbines.

Preferably, the amount of aluminum is in the range of from 1.6 to 4.0 weight % for reducing the tendency of the nickel-base alloy to decrease in elongation and drawing abilities at high temperatures due to an excessive addition of aluminum, resulting in high forgeability maintained for the nickel-base alloy. With the amount of aluminum being in the range of from 1.6 to 4.0 weight %, the amount of titanium is preferably at most 2 weight % for improving sulfidation corrosion resistance of the nickel-base alloy while maintaining the nickel-base alloy highly forgeable, and more preferably at least 1 weight % for maintaining creep strength while keeping high forgeability and sulfidation corrosion resistance.

Preferably, the total amount of titanium and aluminum is at least 4.0 weight % for keeping sufficient high-temperature strength for the nickel-base alloy.

More preferably, the total amount of titanium and aluminum is in the range of from 4.0 to 5.0 weight %. If the total amount of titanium and aluminum exceeds 5 weight %, then the forgeability of the nickel-base alloy would be lowered. Therefore, by limiting the total amount of titanium and aluminum at most 5.0 weight %, the forgeability of the nickel-base alloy is retained to result in a reduction in the manufacturing cost and excellent mechanical properties of the nickel-base alloy. With the total amount of titanium and aluminum being in the range of from 4.0 to 5.0 weight %, the amount of titanium is preferably at most 2 weight % for improving sulfidation corrosion resistance of the nickel-base alloy while maintaining the nickel-base alloy highly forgeable.

According to the present invention, a high-temperature sulfidation-corrosion resistant precipitation-hardened nickel-base alloy comprises at most 2.0 weight % of titanium, at least 2.0 weight % of aluminum, and a remainder essentially of nickel except for impurities.

The high-temperature sulfidation-corrosion resistant nickel-base alloy or the high-temperature sulfidation-corrosion resistant precipitation-hardened nickel-base alloy further includes 0.003~0.01 weight % of boron (B) and 0.02~0.08 weight % of zirconium (Zr).

Boron is precipitated in alloy grain boundaries thereby to increase the grain boundary strength at high temperatures. The amount of boron is required to be at least 0.003 weight % for increasing the grain boundary strength at high temperatures. If the amount of boron exceeds 0.01 weight %, then it would generate a eutectic having a low melting point in grain boundaries, tending to cause a melting failure. Therefore, the amount of boron is limited to the range of 0.003~0.01 weight %.

Zirconium is also precipitation grain boundaries thereby to increase the grain boundary strength. The amount of zirconium is required to be at least 0.02 weight % for increasing the grain boundary strength. If the amount of zirconium were too large, then it would generate intermetallic compounds precipitating in grain boundaries, tending to lower the creep strength. Therefore, the amount of zirconium is limited to the range of 0.02~0.08 weight %.

Inventive examples of the nickel-base alloy according to the present invention and a comparative example of a conventional nickel-base alloy were prepared and subjected to various tests. Results of the tests will be described below.

Figure 6:
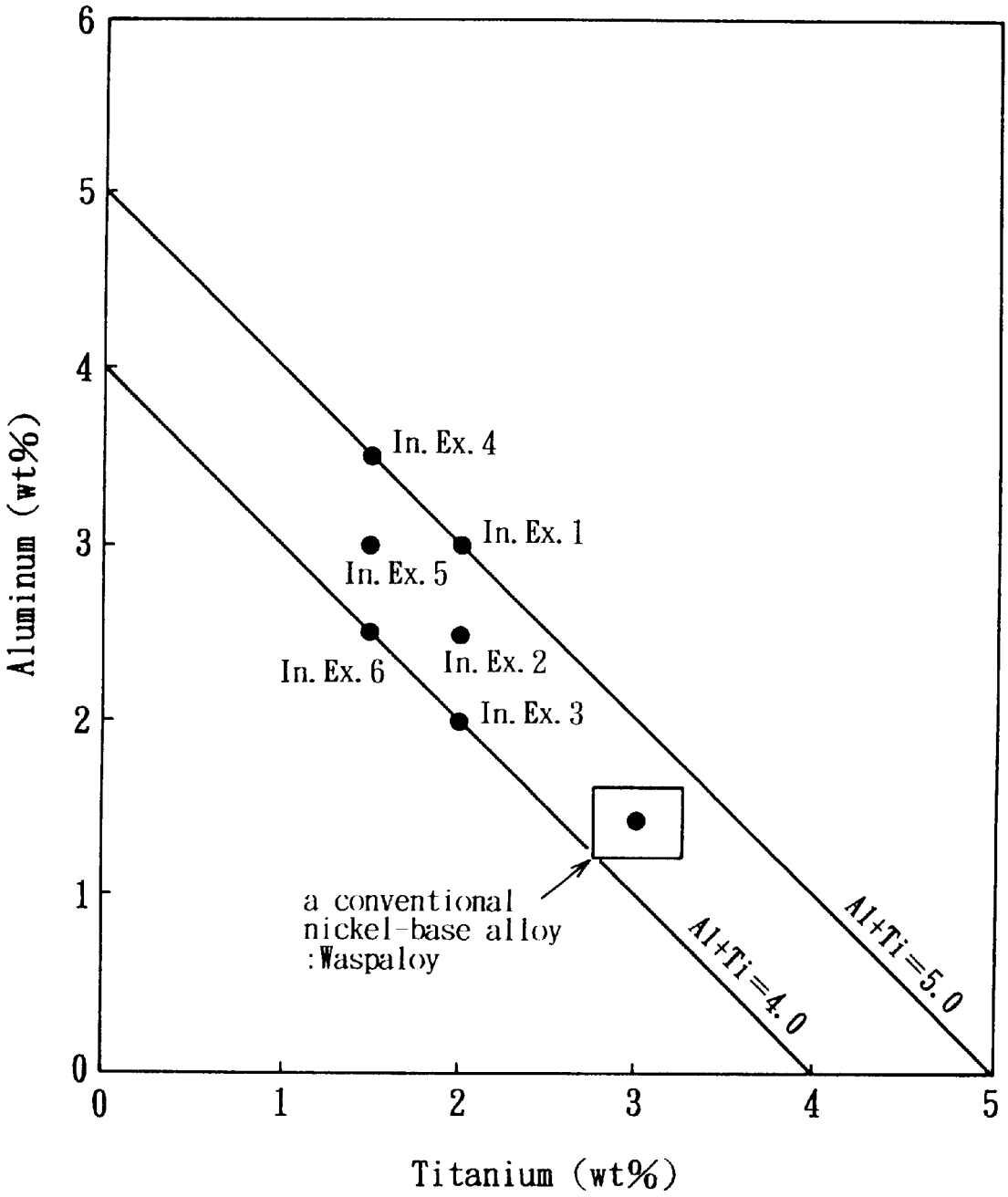
FIG. 6 is a graph showing the compositions of examples of a nickel-base alloy according to the present invention and a comparative example of a conventional nickel-base alloy.

The Table shown below indicates the compositions of examples 1~6 of the invention and a comparative example. Each of the inventive example 1, 2, and 3 contained 2.0 weight % of titanium, and each of the inventive examples 4, 5, and 6 contained 1.5 weight % of titanium. The examples 1~6 of the invention contained 3.0, 2.5, 2.0, 3.5, 3.0, and 2.5 weight % of aluminum respectively. Each of the examples 1~6 of the invention contained 13.5 weight % of cobalt, 20.0 weight % of chromium, 4.2 weight % of molybdenum, 0.04 weight % of carbon, and a remainder of nickel except for impurities. The comparative example was a nickel-base alloy known as Waspaloy, and contained 3.0 weight % of titanium, 1.5 weight % of aluminum, 13.5 weight % of cobalt, 20.0 weight % of chromium, 4.2 weight % of molybdenum, 0.04 weight % of carbon, and a remainder of nickel except for impurities. FIG. 6 shows the compositions of the examples 1~6 of the invention which are represented by respective numbered solid dots and the comparative example which is represented by a solid dot enclosed by a rectangular frame that indicates a composition range of Waspaloy.

TABLE

| Examples | Ti | Al | Ni | Co | Cr | Mo | C |
|---|---|---|---|---|---|---|---|
| Co. Ex (Waspaloy) | 3.0 | 1.5 | | | | | |
| In. Ex. 1 | 2.0 | 3.0 | | | | | |
| In. Ex. 2 | 2.0 | 2.5 | | | | | |
| In. Ex. 3 | 2.0 | 2.0 | Remainder | 13.5 | 20.0 | 4.2 | 0.04 |
| In. Ex. 4 | 1.5 | 3.5 | | | | | |
| In. Ex. 5 | 1.5 | 3.0 | | | | | |
| In. Ex. 6 | 1.5 | 2.5 | | | | | |

(Unit: weight %)

The nickel-base alloys according to the examples 1~6 of the invention and the comparative example were obtained by melting the material metals in an inductive heating furnace in an inert atmosphere and casting it into molds in an inert atmosphere. The cast alloys were then forged to a thickness of 20 mm at a reduction ratio of 56 %. The forged samples were treated 4 hours at 1010° C. for solution treatment and cooled in the atmosphere air, for 4 hours at 843° C. for stabilization and cooled in the atmosphere air, and for 16 hours at 760° C. for precipitation hardening and cooled in the atmosphere air. After those heat treatments, test pieces were cut out of the forged samples. The test pieces were tested for high-temperature strength and high-temperature sulfidation corrosion resistance.

Figure 7:
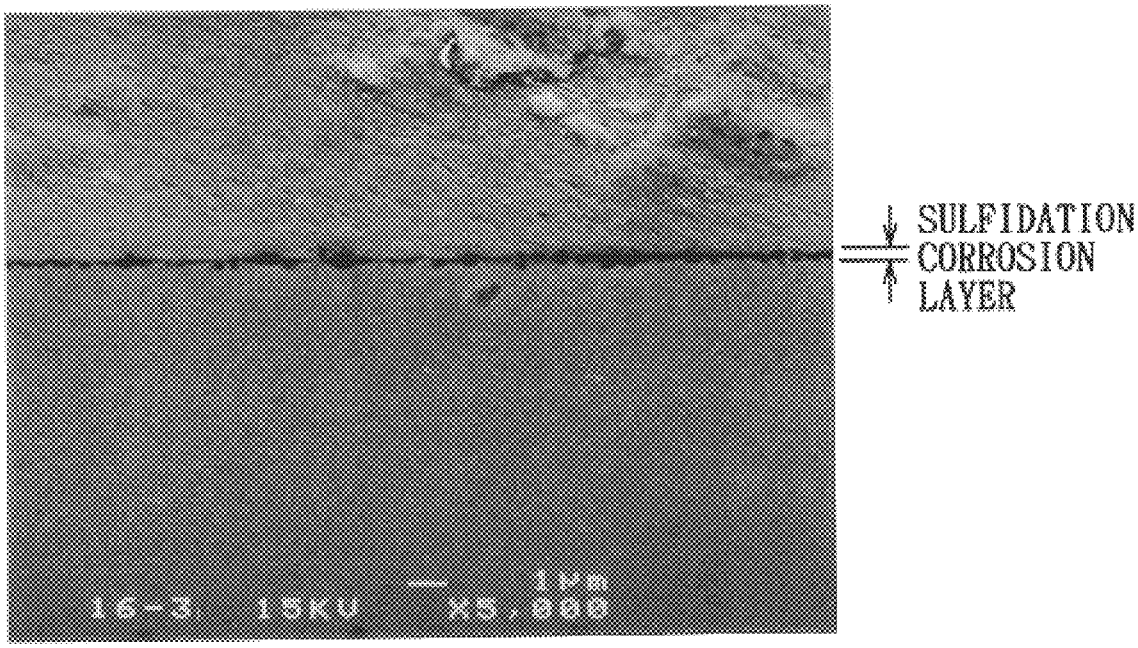
FIG. 7 is a microscopic structural representation of a cross section of the nickel-base alloy according to the present invention, showing results of a high-temperature sulfidation-corrosion test conducted on the nickel-base alloy.
Figure 12:
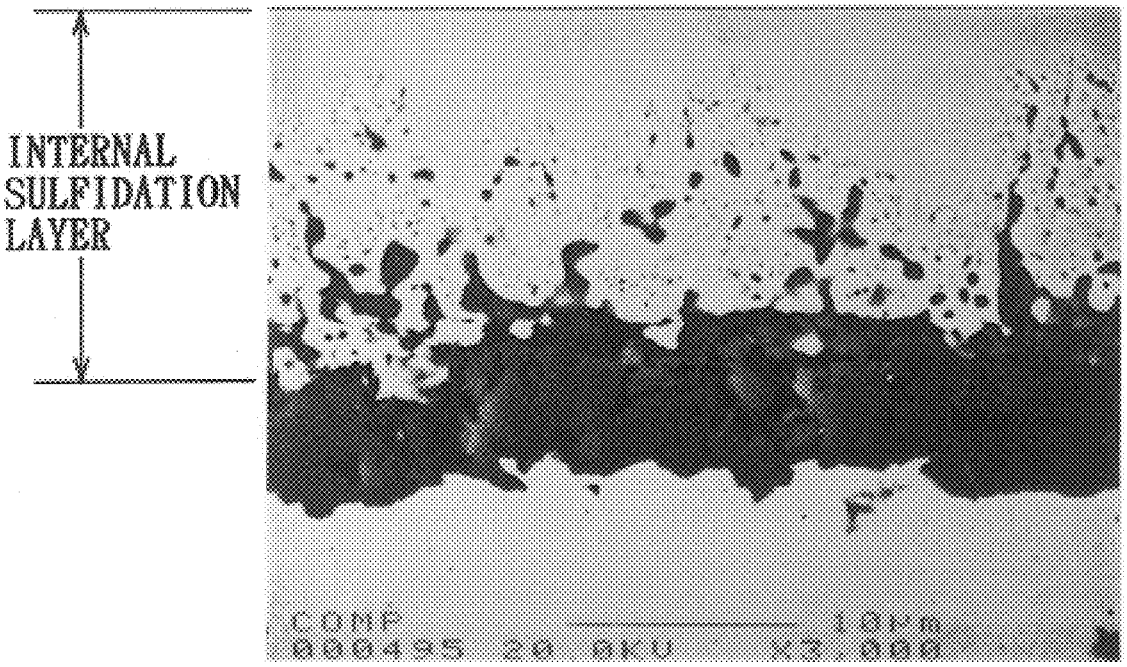
FIG. 12 is a microscopic structural representation of a cross section of the nickel-base alloy according to the comparative example, showing results of a high-temperature sulfidation-corrosion test conducted on the nickel-base alloy.

FIG. 7 shows results of a sulfidation test conducted by exposing the nickel-base alloy in a sulfidizing gas atmosphere of a sulfur partial pressure ($PS_2$) of $10^{-12}$ atm. at a temperature of 600° C. for 49 hours. As shown in FIG. 7, a sulfidation corrosion layer including a grain boundary corrosion in the nickel-base alloy had a width of 0.2 $\mu$m which was much smaller than the width of 12.6 $\mu$m (see FIG. 12) of a sulfidation corrosion layer in the conventional nickel-base alloy (Waspaloy), indicating highly improved sulfidation resistance of the nickel-base alloy according to the present invention.

Figure 8:
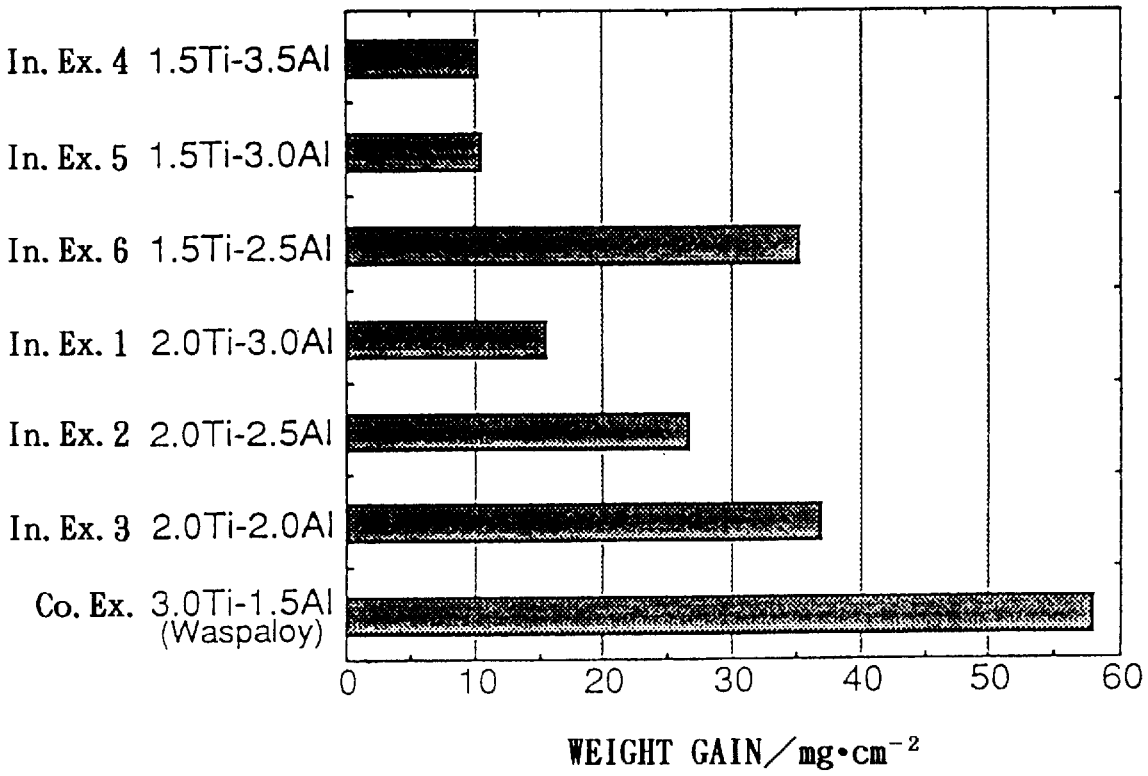
FIG. 8 is a graph showing results of a high-temperature sulfidation-corrosion test conducted on the examples of the invention and the comparative example.

FIG. 8 illustrates results of a high-temperature sulfidation-corrosion test conducted on the examples 1~6 of the invention and the comparative example in a sulfiding gas under a sulfur partial pressure ($PS_2$) of $10^{-9}$ atm. at a temperature of 600° C. for 49 hours. A review of FIG. 8 indicates that the sulfidation corrosion resistance of the examples 1~6 of the invention was greatly improved over that of the comparative example.

Figure 9A:
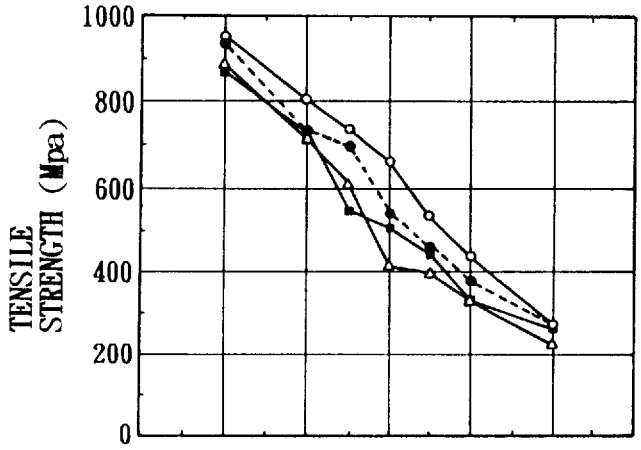
FIGS. 9(A), 9(B), and 9(C) and FIGS. 10(A), 10(B), and 10(C) are graphs showing high-temperature strength characteristics for hot working processes of the comparative example and the inventive examples.
Figure 9B:
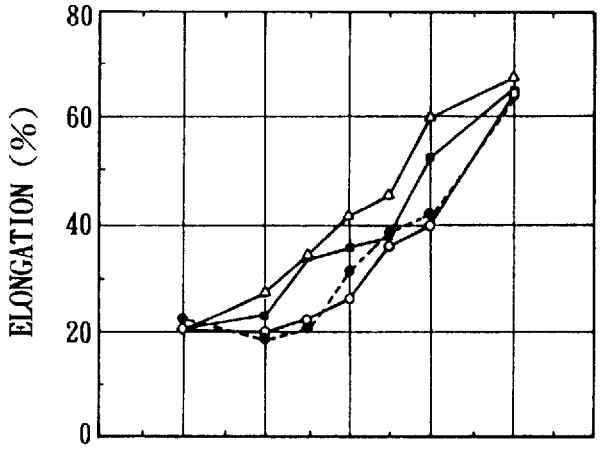
Figure 9C:
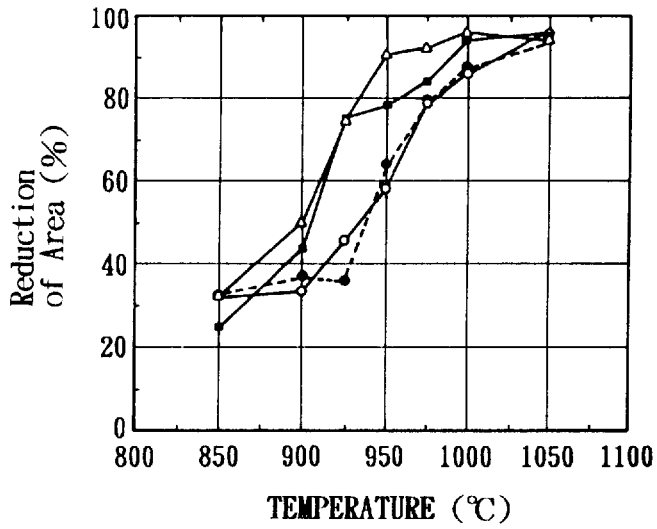
Figure 10A:
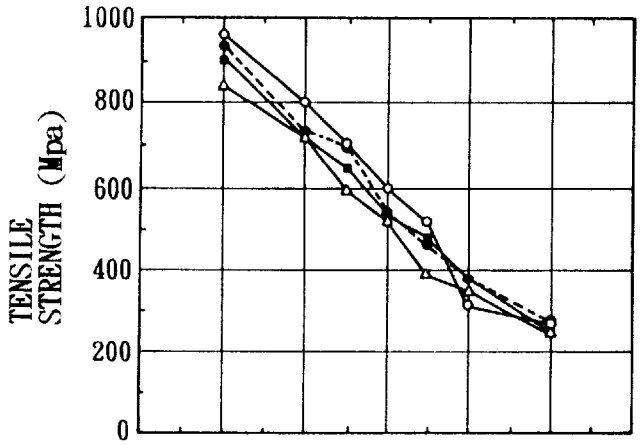
Figure 10B:
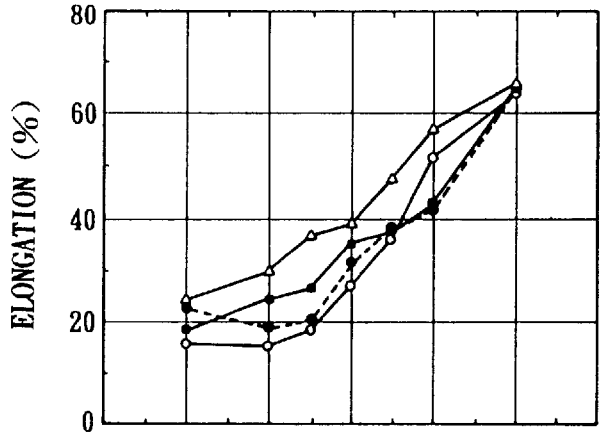
Figure 10C:
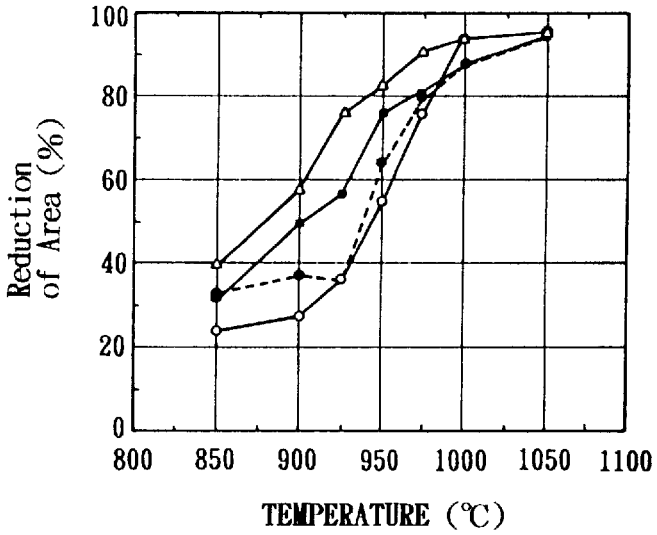
Figure 11:
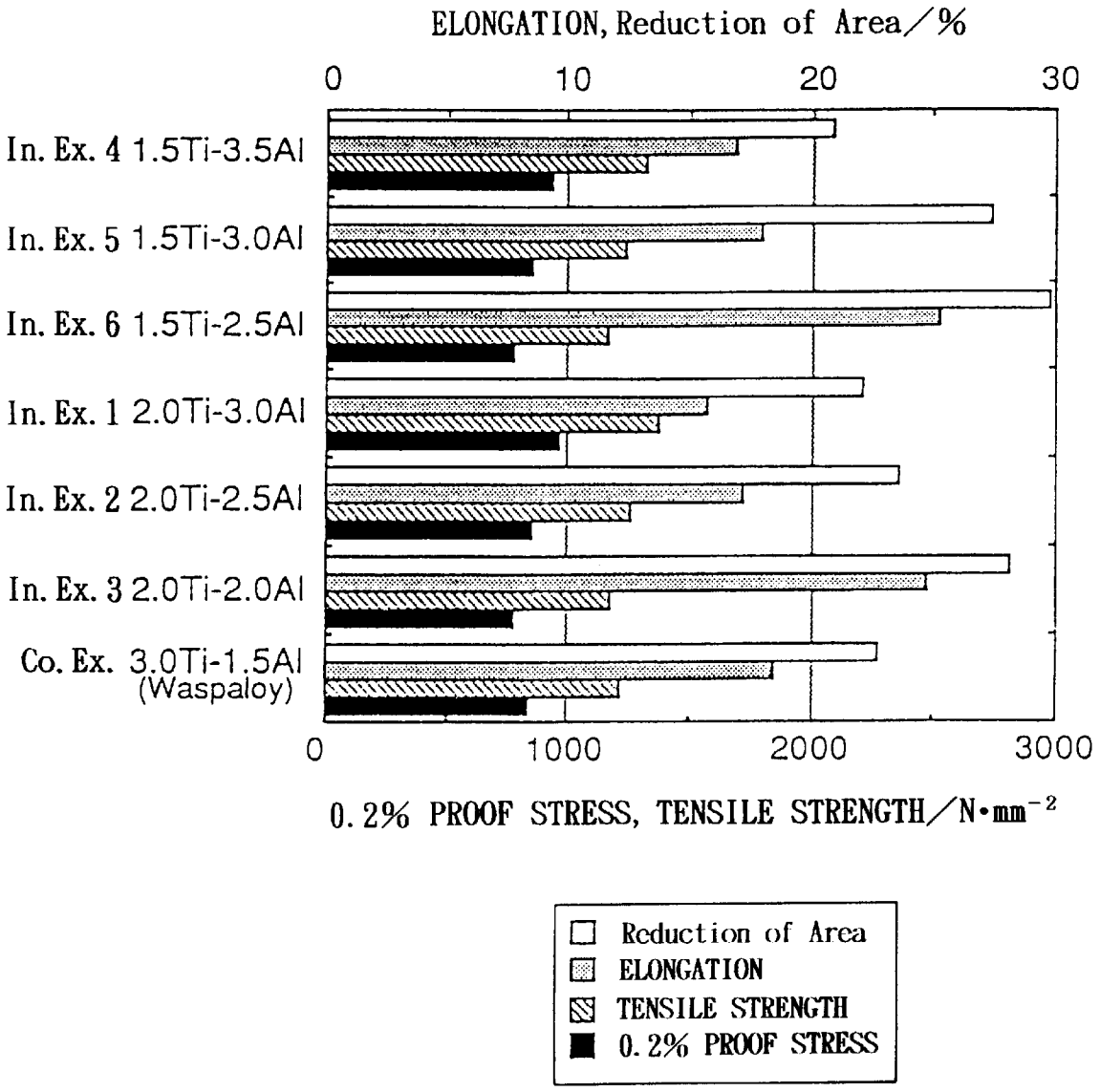
FIG. 11 is a graph showing high-temperature strength characteristics of the examples of the invention and the comparative example.

FIGS. 9(A) through 9(C) show high-temperature strength characteristics of the examples 1~3 of the invention compared with the comparative example during hot working processes at temperatures ranging from 850~1050° C., and FIGS. 10(A), 10(B), and 10(C) show high-temperature strength characteristics of the examples 4~6 of the invention compared with the comparative example during hot working processes at temperatures ranging from 850~1050° C. FIG. 11 illustrates high-temperature strength characteristics of the examples 1~6 of the invention at 538° C. compared with the comparative example. A study of FIGS. 9(A)~9(C), 10(A) ~10(C), and 11 reveals that the nickel-base alloy according to the present invention is equivalent to the conventional nickel-base alloy of Waspaloy with respect to various high-temperature properties including 0.2 % proof stress, tensile strength, elongation, and reduction of area.

Although certain preferred embodiments of the present invention have been shown and described in detail, it should be understood that various changes and modifications may be made therein without departing from the scope of the appended claims.

What is claimed is:

1. A high-temperature sulfidation-corrosion resistant nickel-base alloy comprising 12~15 weight % of cobalt, 18~21 weight % of chromium, 3.5~5 weight % of molybdenum, 0.02~0.1 weight % of carbon, at most 2.75 weight % of titanium, at least 1.6 weight % of aluminum, and a remainder essentially of nickel except for impurities.

2. A high-temperature sulfidation-corrosion resistant nickel-base alloy according to claim 1, wherein the amount of titanium is at most 2.0 weight %.

3. A high-temperature sulfidation-corrosion resistant nickel-base alloy according to claim 1, wherein the amount of titanium is in the range of from 1.0 to 2.0 weight %.

4. A high-temperature sulfidation-corrosion resistant nickel-base alloy according to claim 1, wherein the amount of aluminum is in the range of from 1.6 to 4.0 weight %.

5. A high-temperature sulfidation-corrosion resistant nickel-base alloy according to claim 4, wherein the amount of titanium is at most 2 weight %.

6. A high-temperature sulfidation-corrosion resistant nickel-base alloy according to claim 5, wherein the amount of titanium is in the range of from 1.0 to 2.0 weight %.

7. A high-temperature sulfidation-corrosion resistant nickel-base alloy according to claim 1, wherein the total amount of titanium and aluminum is at least 4.0 weight %.

8. A high-temperature sulfidation-corrosion resistant nickel-base alloy according to claim 1, wherein the total amount of titanium and aluminum is in the range of from 4.0 to 5.0 weight %.

9. A high-temperature sulfidation-corrosion resistant nickel-base alloy according to claim 8, wherein the amount of titanium is at most 2 weight %.

10. A high-temperature sulfidation-corrosion resistant nickel-base alloy according to claim 1, further comprising 0.003~0.01 weight % of boron and 0.02~0.08 weight % of zirconium.

11. A high-temperature sulfidation-corrosion resistant precipitation-hardened nickel-base alloy comprising at most 2.0 weight % of titanium, at least 2.0 weight % of aluminum, and a remainder essentially of nickel except for impurities.

12. A high-temperature sulfidation-corrosion resistant precipitation-hardened nickel-base alloy according to claim 11, further comprising 0.003~0.01 weight % of boron and 0.02~0.08 weight % of zirconium.

13. A high-temperature sulfidation-corrosion resistant nickel-base alloy according to claim 1, wherein the amount of titanium is at most 2 weight %, and the amount of aluminum is at least 2.0 weight %.

14. A high-temperature sulfidation-corrosion resistant nickel-base alloy according to claim 1, wherein the total amount of titanium and aluminum is at least 3.0 weight %.

* * * * *